US005292198A

United States Patent [19]

Röck et al.

[11] Patent Number: 5,292,198

[45] Date of Patent: Mar. 8, 1994

[54] PULL-OUT GUIDE FITTING FOR DRAWERS

[75] Inventors: Erich Röck, Höchst, Austria; Fredi Dubach, Adetswil, Switzerland

[73] Assignee: Julius Blum Gesellschaft m.b.H., Höchst, Austria

[21] Appl. No.: 28,949

[22] Filed: Mar. 8, 1993

[30] Foreign Application Priority Data

Mar. 11, 1992 [AT] Austria ..... 474/92

[51] Int. Cl.[5] ..... A47B 88/04

[52] U.S. Cl. ..... 384/21; 312/333; 384/18

[58] Field of Search ..... 384/18, 19, 21, 22; 312/333

[56] References Cited

U.S. PATENT DOCUMENTS

| | | | |
|---|---|---|---|
| 2,496,997 | 2/1950 | Hallberg . | |
| 2,639,042 | 5/1953 | Lambert et al. . | |
| 3,937,531 | 2/1976 | Hagen et al. . | |
| 4,212,503 | 7/1980 | Litchfield et al. | 384/21 |
| 4,274,689 | 6/1981 | Vander Ley et al. | 312/333 |
| 4,423,914 | 1/1984 | Vander Ley | 312/333 |
| 4,440,455 | 4/1984 | Lanting et al. . | |
| 4,465,324 | 8/1984 | Röck et al. | 384/19 |
| 4,473,262 | 9/1984 | Staye | 312/333 |
| 4,778,230 | 10/1988 | Lautenschläger | 312/341 R |
| 4,799,802 | 1/1989 | Lautenschlager | 384/21 X |
| 4,953,991 | 9/1990 | Röck | 384/19 |
| 4,961,648 | 10/1990 | Röck | 384/22 X |
| 4,998,828 | 3/1991 | Hobbs | 384/18 |

FOREIGN PATENT DOCUMENTS

| | | |
|---|---|---|
| 90027671 | 6/1990 | Fed. Rep. of Germany . |
| 91135699 | 2/1992 | Fed. Rep. of Germany . |
| 2226752 | 7/1990 | United Kingdom . |

*Primary Examiner*—Thomas R. Hannon

*Attorney, Agent, or Firm*—Wenderoth, Lind & Ponack

[57] ABSTRACT

A pull-out guide fitting for a drawer includes a drawer-side pull-out rail and a furniture carcass-side support rail, and possibly a middle rail disposed between the pull-out rail and the support rail. The support rail is mounted by support structure or coupling members on a support bracket that in turn is mounted on a carcass side panel. At the rear of the support bracket is a hook under which the support rail is insertable. The support rail is held in the inserted position by a locking lever that is supported on or in the support rail. The locking lever is acted upon by a spring to pivot to a locked position abutting against a detent edge of the support bracket.

41 Claims, 7 Drawing Sheets

PULL-OUT GUIDE FITTING FOR DRAWERS

BACKGROUND OF THE INVENTION

The invention relates to a pull-out guide assembly or fitting for a drawer, and including one drawer-side pull-out rail and one furniture wall or carcass-side support rail to be employed on either side of the drawer, and preferably in each case one middle rail disposed between the pull-out rail and the support rail. The support rail is supported with the aid of coupling members on a support bracket or brackets which in turn is mounted on a respective furniture or carcass side panel. Rear ends of the support brackets have hooks under which the support rails are insertable. The support rails are held in an inserted position by locking levers that are pivotably supported on the support rails and that abut against detect edges of the support brackets.

Generally it is standard practice, when manufacturing an article of furniture, to fasten the support rails of the pull-out guide fittings to furniture carcass side panels and to fasten the pull-out rails to the drawer. In many cases, however, it is desirable for the rails of the pull-out guide fitting to be incapable of being separated while in use, so that it is impossible to separate the rails for assembly. Furthermore, it is desirable for the furniture parts, in particular the side panels, to be easy to stack and package. A precondition for this is that there are no projecting, or only slightly projecting, parts assembled on the side panels of the article of furniture.

AT-PS 379 497 discloses a pull-out guide fitting for a drawer in which the support rail is fastened on a support bracket which is fastened to the side panel of the article of furniture. As a result, the entire pull-out guide fitting on each side of the drawer, including pull-out rail, running carriage and support rail, may be assembled on the drawer and is attached or anchored, on insertion of the drawer into the carcass of the article of furniture, on the respective support bracket. A drawback of such known pull-out guide fitting is that inexact manufacture may lead to excessive play between the support rails and the support brackets, which may affect the fit and smooth running or movement of the drawer. Furthermore, there are no means which prevent the drawer from being lifted off from the support brackets.

U.S. Pat. No. 4,423,914 discloses a pull-out guide fitting, in which the pull-out rails are anchored on respective support brackets of the drawer. Longitudinal displacement of the pull-out rails is prevented by locking levers. The complete pull-out guide fitting cannot however be preassembled on the drawer prior to assembly of the article of furniture.

SUMMARY OF THE INVENTION

The object of the invention is to provide an improved pull-out guide fitting wherein the support rail, which is mounted on the drawer via the pull-out rail prior to mounting or anchoring of the drawer in the article of furniture, is held snugly on the support bracket, even with standard manufacturing tolerances by connection structure. The pull-out guide fitting according to the invention is particularly suitable for fully extendable drawers, i.e. drawers in which a so-called middle rail is disposed between each support rail and the corresponding pull-out rail.

Such object is achieved according to the invention in that the connection structure includes a locking lever that is acted upon by a spring and is supported in a housing fastened to or in the support rail and that there is disposed in the housing a catch formed by a horizontally displaceable ball or detent pin which acted upon by a spring and locks into a snap-in groove or the like formed in the support bracket.

The locking lever advantageously is provided with steps, one of which abuts against a detent edge, thereby allowing improved compensation of assembly tolerances. The drawer is prevented from unintentionally being lifted off from the support brackets by the provision in the housings of the horizontally displaceable balls or detent pins that are acted upon by the springs and that lock into the snap-in grooves or the like formed in the support brackets. However, the drawer may be pulled upwardly with the support rails and hence released from the support brackets without damage to the catches.

For assembly, the drawer with the pull-out guide fittings is placed onto the support brackets and is pushed rearwardly until the rear ends of the support rails lock in under hooks of the support brackets. As soon as each locking lever is located adjacent a respective edge, the lever is moved by its spring into a pivoted locking position, thereby locking the support rail against axial displacement. Such spring may be a spiral spring or a pressure spring.

BRIEF DESCRIPTION OF THE DRAWINGS

There follows a description of two embodiments of the invention with reference to the accompanying drawings, wherein:

FIG. 3 is an identical side view, but with the drawer shown pushed in;

DETAILED DESCRIPTION OF THE INVENTION

Figure 1A:
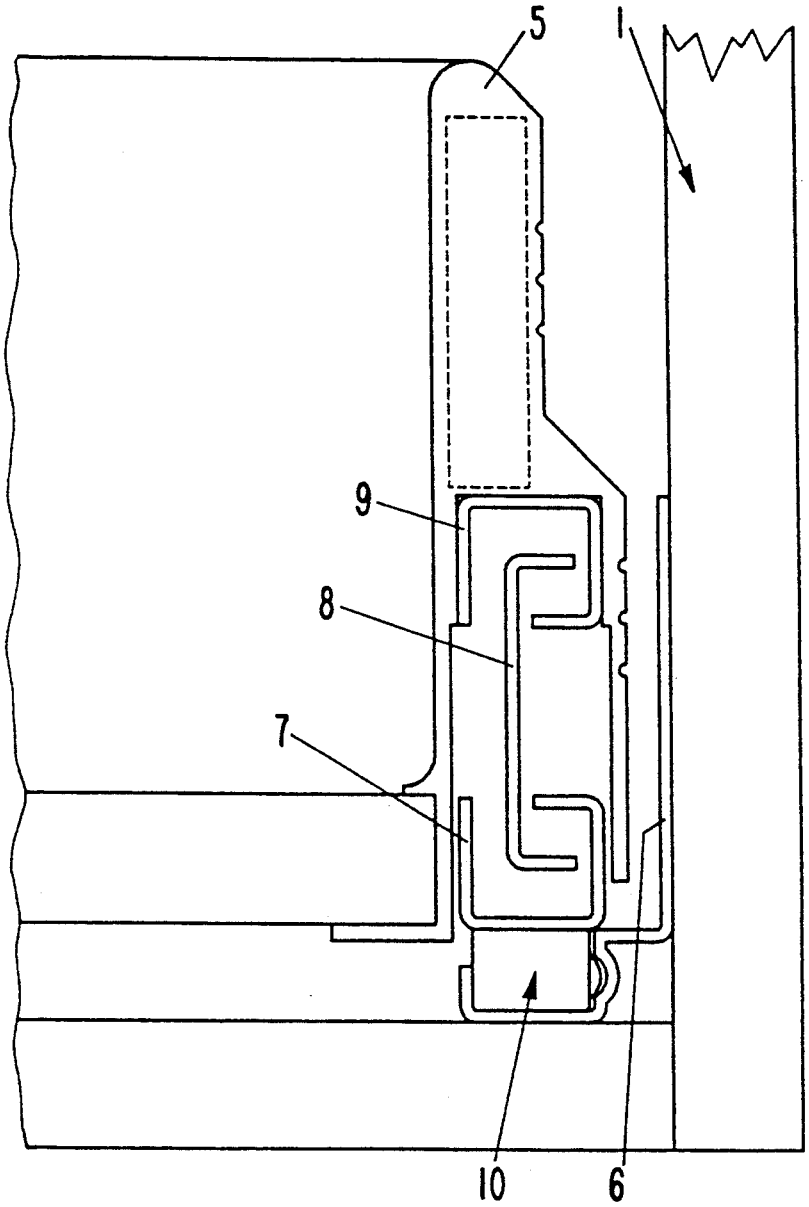
FIGS. 1*a* and 1*b* are cross-sectional views of drawers having different embodiments of pull-out guide fittings according to the invention.
Figure 1B:
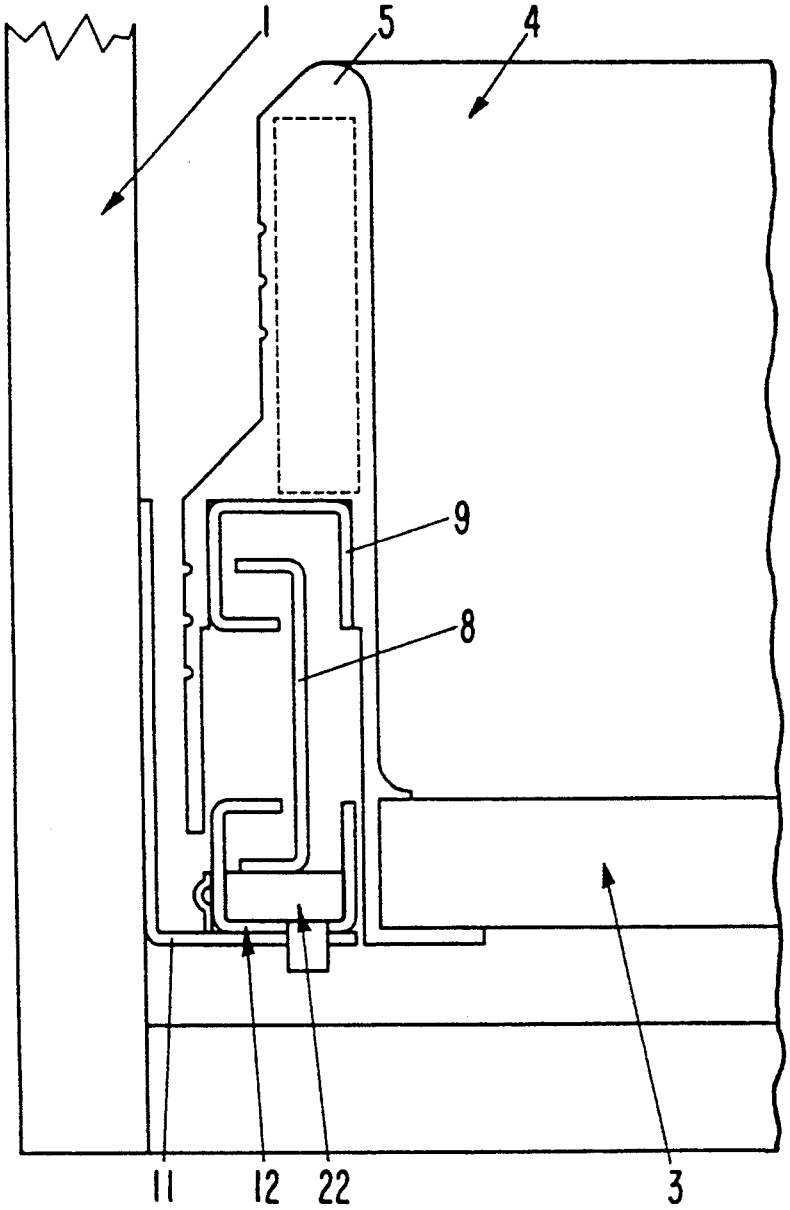
Figure 2:
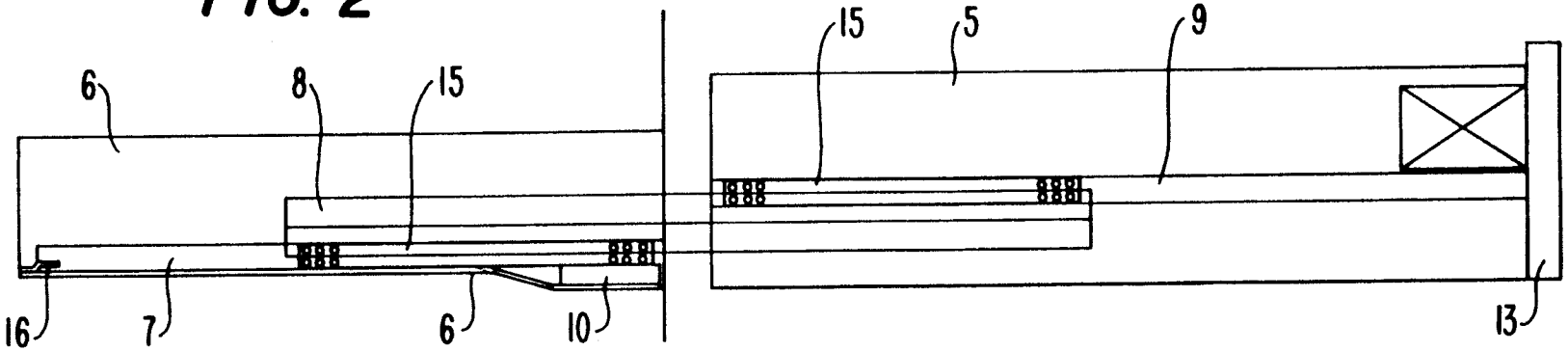
FIG. 2 is a side view of a drawer and a pull-out guide fitting, with the drawer shown pulled out.
Figure 3:
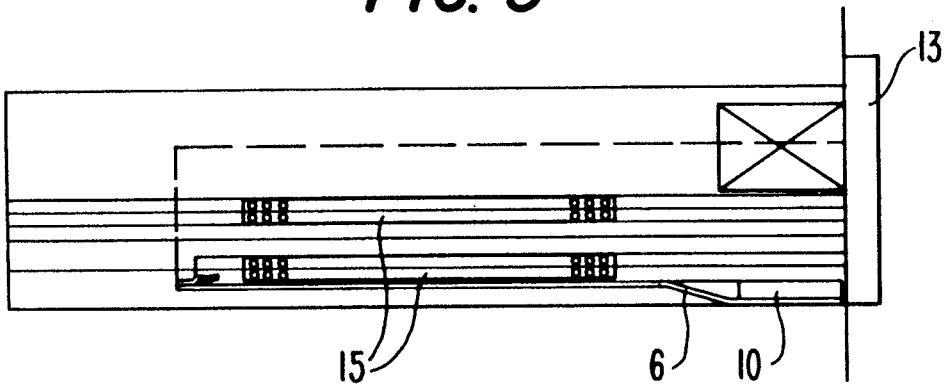
Figure 4:
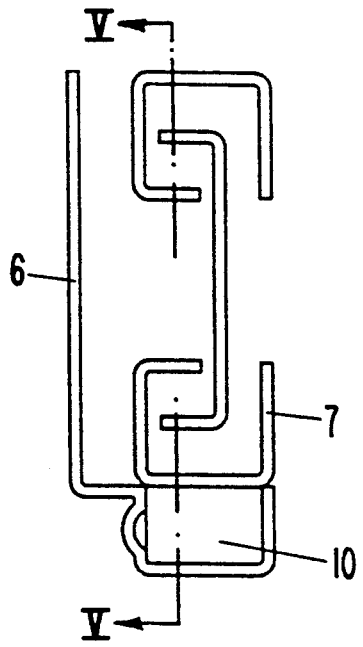
FIG. 4 is a cross-sectional view of one side of a pull-out guide fitting according to the embodiment of FIG. 1*a;*
Figure 5:
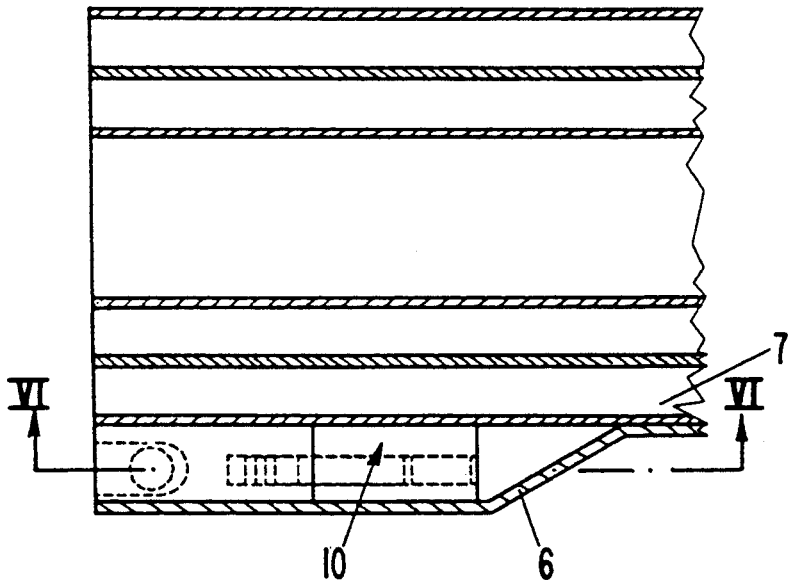
FIG. 5 is a section along line V—V in FIG. 4.

In the following, reference is made to only one side of a drawer. The other side is identical in construction. As shown in FIGS. 1*a* and 1*b*, each pull-out guide fitting or assembly includes a pull-out rail 9, a middle rail 8 and a support or carcass rail 7 or 12. Running carriages 15 are supported between the support rails 7, 12 and the middle rails 8 and the pull-out rails 9 (FIGS. 2 and 3). The running carriages 15 are manufactured according to conventional prior art arrangements and are not shown in detail in the drawings. The rails 7, 8, 9, 12 are inserted into respective drawer side panels 5, while support brackets 6, 11 are fastened to respective furniture or carcass side panels 1. In the drawings, a drawer base or bottom is designated 3, a drawer back panel 4 and a drawer front panel 3.

The following is a description of the embodiment of FIG. 1*a*, and is made with reference to FIGS. 4 to 9. Fastened to the underside of the support rail 7, close to its front end, is a housing 10. Fastening may be effected by screws, rivets or adhesive. Supported in the housing 10 is a locking or pivot lever 17, which is pivotable about a vertical axis 18. The lever 17 is acted upon by a first spring 19 and is urged thereby to pivot about axis 18 to move the end of a first lever arm 17′ away from and out of housing 10. An opposite or second lever arm 17″ has a stop 28 urged to abut against a wall 29 of housing 10 to prevent the lever 17 from springing too far outwardly, i.e. to limit the extent of pivoting of lever 17.

Figure 6:
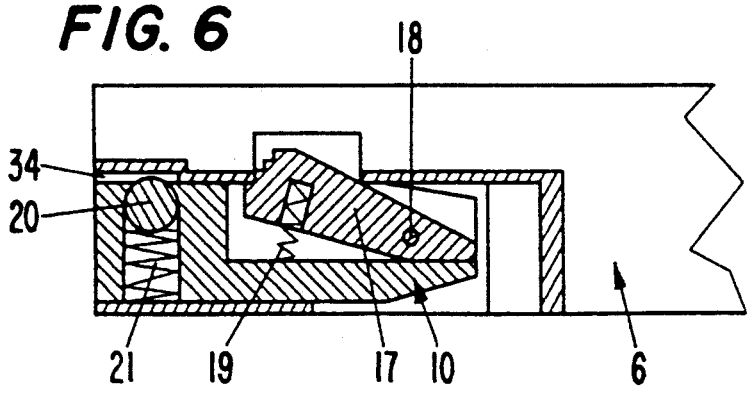
FIG. 6 is a section along line VI—VI in FIG. 5.
Figure 7:
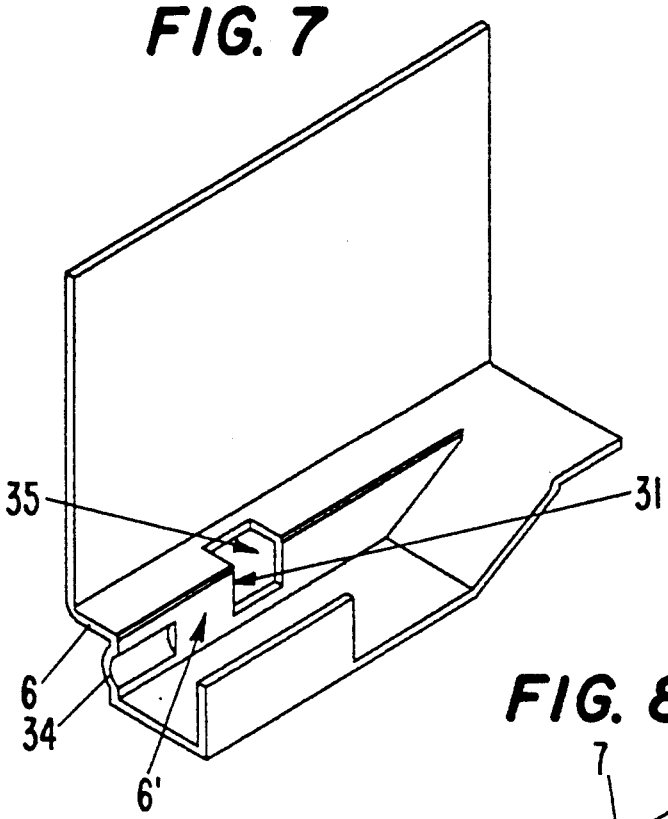
FIG. 7 is a perspective view of the front end of a support bracket.
Figure 8:
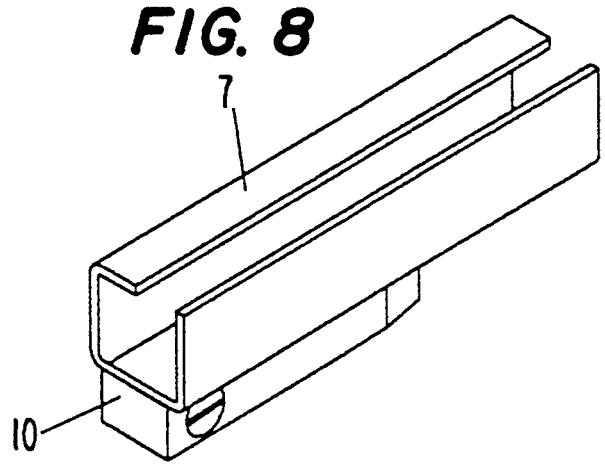
FIG. 8 is a perspective view of the front end of a support rail.
Figure 9:
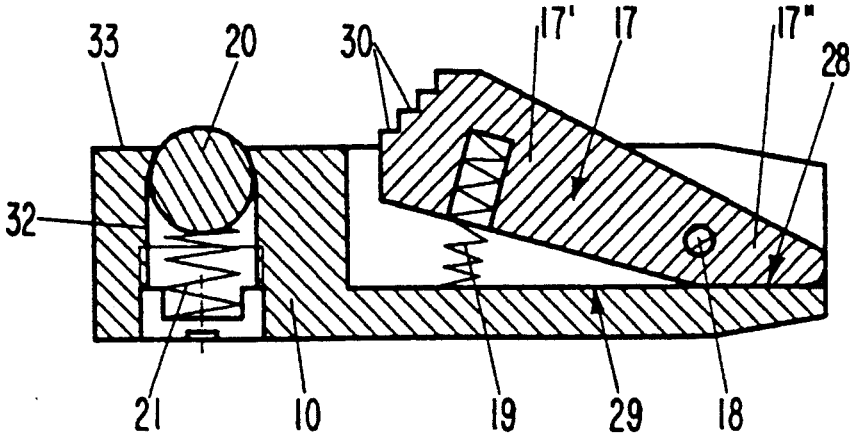
FIG. 9 is a horizontal section through a catch device.
Figure 10:
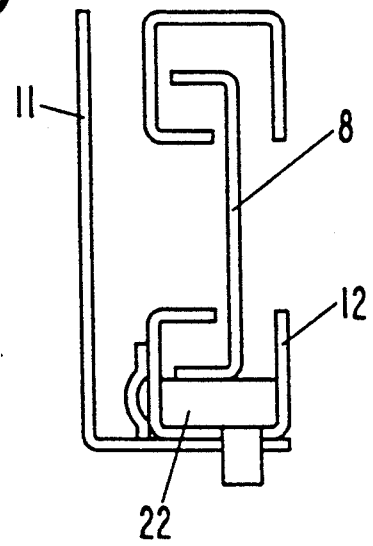
FIGS. 10 to 14 are views analogous to FIGS. 4 to 8 but according to the embodiment of FIG. 1*b*.
Figure 11:
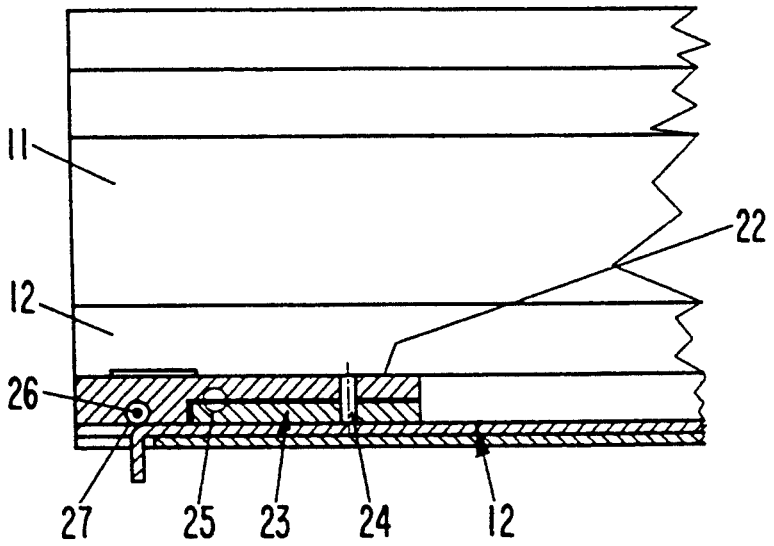
Figure 12:
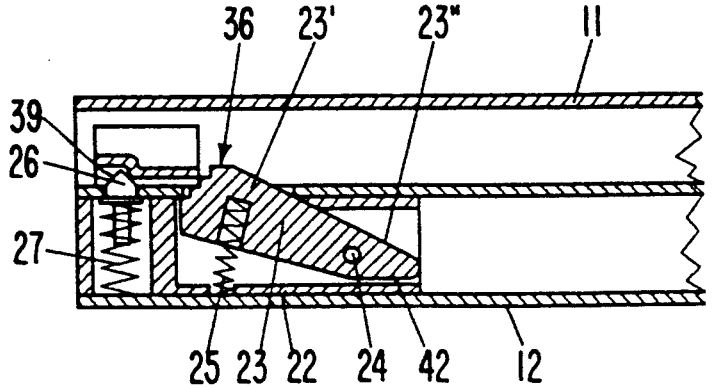
Figure 13:
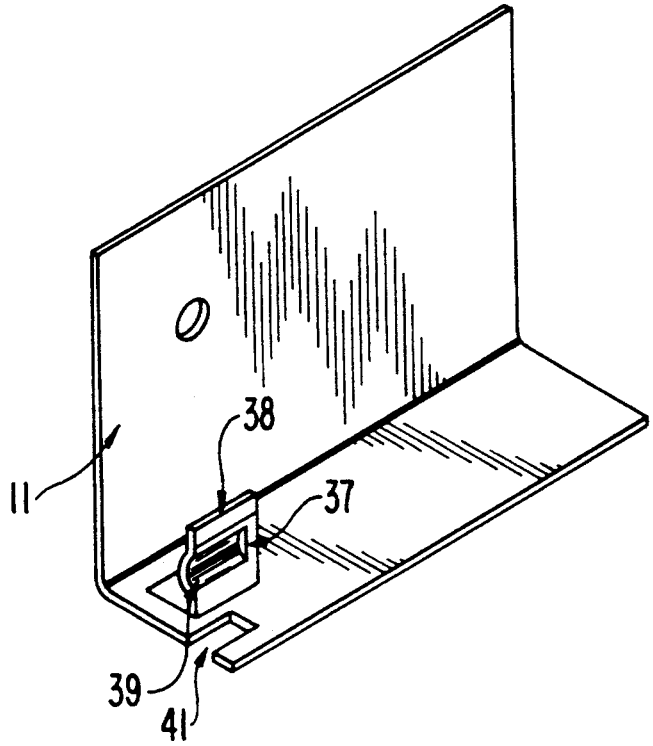
Figure 14:
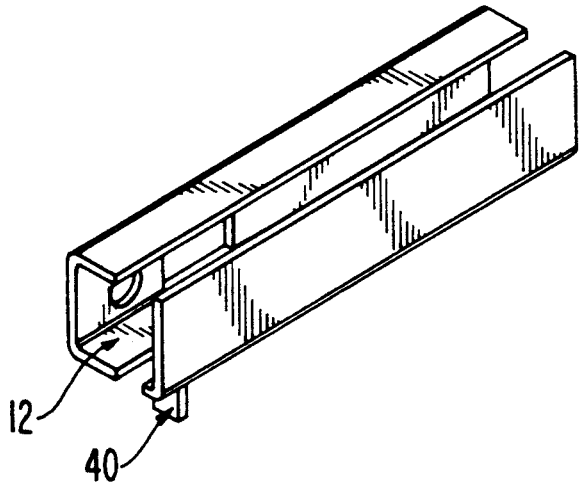

The forward or outer end of the first lever arm 17′ of the lever 17 is provided with steps 30 one of which, in the locked or assembled position, abut against a detent edge 31 of a recess 35 formed in the support bracket 6. FIG. 6 shows the lever 17 in its locked position. Situated in the housing 10 is a cylindrical opening 32 in which a catch member, e.g. a ball 20, is supported. The ball 20 is acted upon and pressed outwardly by a helical second spring 21. The cylindrical opening 32 has at the front thereof, i.e. at the release side of the rocking lever 17 or at the end to which ball 20 is urged, a taper 33 to prevent the ball 20 from falling out of the housing 10. In the assembled position, the ball 20 extends into a catch, e.g. a groove 34, in the support bracket 6. The support bracket 6 is provided at the rear thereof with a hook 16 (FIG. 2).

To assemble the drawer and the pull-out guide fitting, the drawer with the support rails 7 is placed onto the support brackets 6. The drawer with the support rails 7 is then pushed rearwardly until the rear ends of horizontal webs of the support rails 7 are pushed under the hooks 16. In such position, the lever 17 lies adjacent to the recess 35 formed, e.g. by punching, in a side web 6′ of the support bracket 6. Lever 17 is pressed by the helical spring 20 into the recess 35 so as to cause a step 30 to abut against the detent edge 31 of the recess 35. The support rails 7 are therefore locked in the axial direction onto the support brackets 6. The spring 19 is sufficiently strong to prevent unintentional displacement of the support rails 7 relative to brackets. Because of the balls 20, which are pressed by the springs 21 into the grooves 34, it is also impossible for the support rails 7 to be lifted easily from the support brackets 6. If the support rails 7 are to be lifted from the support brackets 6, the support rails are pressed upwardly until the pressure of the pressure springs 21 is overcome. The front ends of the support rails 7 are thereby released.

In the embodiment of FIG. 1*b*, which is shown in greater detail in FIGS. 10 to 14, a housing 22 is supported directly in the support rail 12. Once again, a locking or pivot lever 23 is supported on an axis 24 in the housing 22 and is acted upon by a helical spring 25. The lever 23 has steps 36.

Assembly of the pull-out guide fittings on the support brackets 11 is effected in a manner identical to that of the previously described embodiment. The support rails 12 are placed onto horizontal webs of the support brackets 11 and pushed rearwardly until rear ends of rails 12 come to lie under the hooks 16. In such position, the lever 23 lies directly adjacent a detent edge 37 formed by a tab 38 punched out of a horizontal web of the support bracket 11. The tab 38 additionally has a groove 39. In the housing 22 is, instead of ball 20, a pin 26 with a conical tip. The pin 26 is acted upon by a pressure spring 27 and (when the support rail 12 is assembled) is pressed outwardly, i.e. towards the tab 38 and into the groove 39. For more precise positioning of the support rail 12, rail 12 is provided with a downwardly directed tab 40 which, when the support rail 12 is assembled, projects into a punched recess 41 in a horizontal web of the support bracket 11. The pin 26 prevents the support rail 12 from being unintentionally lifted from the support bracket 11.

For removal of the pull-out guide fittings, the support rails 12 are pressed upwardly against the action of the springs 27 until the front ends of the support rails 12 are released. This is effected without damage to the catches formed on the pins 26, the springs 27 and the grooves 39.

In this embodiment also the rocking lever is in the form of a two-armed lever including first and second lever arms 23′, 23″ with lever arm 23″ having a stop face 42 which, when the support rail 12 is not assembled, prevents excessive pivoting or release of the lever 23.

We claim:

1. In an assembly for use on each of opposite sides of a drawer for guiding sliding movement thereof into and out of a furniture body, said assembly including at least one bracket to be mounted on a respective side of the furniture body, a pull-out guide fitting to be mounted on the drawer and to be mounted on said bracket when the drawer and said fitting are assembled to the furniture body, said fitting including at least a support rail to be fixed relative to the furniture body when the drawer is assembled thereto and a pull-out rail to be fixed relative to the drawer and to be longitudinally slidable relative to said support rail, and a connection structure for, upon assembly of the drawer and said fitting to the furniture body, attaching said support rail to said bracket such that said support rail is fixed relative to the furniture body while said pull-out rail and the drawer are longitudinally slidable relative thereto, the improvement wherein said connection structure comprises:

a detent edge and a catch on said bracket;

a housing on said support rail;

a locking lever mounted on said housing for pivotal movement relative thereto about an axis;

a first spring mounted to urge said locking lever about said axis in a direction such that, upon assembly of the drawer and said fitting to the furniture body, said locking lever abuts said detent edge and thereby prevents movement in a first direction of said support rail relative to said bracket;

a catch member mounted on said housing; and a second spring mounted to urge said catch member relative to said housing in a direction such that, upon assembly of the drawer and said fitting to the furniture body, said catch member abuts said catch and thereby prevents movement of said support rail relative to said bracket in a second direction transverse to said first direction.

2. The improvement claimed in claim 1, wherein said fitting further includes a middle rail disposed between said support rail and said pull-out rail.

3. The improvement claimed in claim 1, wherein said bracket has at a rear end thereof a hook that engages with a rear end of said support rail when the drawer and said fitting are assembled to the furniture body.

4. The improvement claimed in claim 1, wherein said housing extends downwardly from an underside of said support rail.

5. The improvement claimed in claim 1, wherein said housing is located within said support rail.

6. The improvement claimed in claim 1, wherein said detent edge is defined by a recess formed in said bracket.

7. The improvement claimed in claim 1, wherein said detent edge is an edge of a tab bent from said bracket.

8. The improvement claimed in claim 7, wherein said catch is formed on said tab.

9. The improvement claimed in claim 1, wherein said catch comprises a groove formed in said bracket.

10. The improvement claimed in claim 9, wherein said groove is elongated parallel to said first direction.

11. The improvement claimed in claim 1, wherein said catch member is within said housing.

12. The improvement claimed in claim 11, wherein said second spring is located in said housing and urges said catch member to project from said housing.

13. The improvement claimed in claim 1, wherein said catch member is ball-shaped.

14. The improvement claimed in claim 1, wherein said catch member is pin-shaped.

15. The improvement claimed in claim 1, wherein said locking lever is mounted within said housing.

16. The improvement claimed in claim 1, wherein said axis extends vertically and said first spring urges said locking lever horizontally outwardly relative to said housing.

17. The improvement claimed in claim 1, wherein said second spring urges said catch member horizontally outwardly relative to said housing.

18. The improvement claimed in claim 1, wherein said first direction is parallel to a longitudinal dimension of said support rail.

19. The improvement claimed in claim 18, wherein said first direction is horizontal, and said second direction is vertically upward.

20. The improvement claimed in claim 1, wherein said locking lever comprises a double-armed lever including a first lever arm having an outer end to abut said detent edge and a second lever arm abutting said housing to limit the extent of pivoting of said lever arm about said axis.

21. In a pull-out guide fitting for use on each of opposite sides of a drawer for guiding sliding movement thereof into and out of a furniture body and to be mounted on the drawer and to at least one bracket to be mounted on a respective side of the furniture body, said fitting including at least a support rail to be fixed relative to the furniture body when the drawer is assembled thereto and a pull-out rail to be fixed relative to the drawer and to be longitudinally slidable relative to said support rail, the improvement comprising:

a housing on said support rail;

a locking lever mounted on said housing for pivotal movement relative thereto about an axis;

a first spring mounted to urge said locking lever about said axis in a direction such that, upon assembly of the drawer and said fitting to the furniture body, said locking lever abuts a detent edge on the bracket and thereby prevents movement in a first direction of said support rail relative to the bracket;

a catch member mounted on said housing; and a second spring mounted to urge said catch member relative to said housing in a direction such that, upon assembly of the drawer and said fitting to the furniture body, said catch member abuts a catch on the bracket and thereby prevents movement of said support rail relative to the bracket in a second direction transverse to said first direction.

22. The improvement claimed in claim 21, wherein said fitting further includes a middle rail disposed between said support rail and said pull-out rail.

23. The improvement claimed in claim 21, wherein said housing extends downwardly from an underside of said support rail.

24. The improvement claimed in claim 21, wherein said housing is located within said support rail.

25. The improvement claimed in claim 21, wherein said catch member is within said housing.

26. The improvement claimed in claim 25, wherein said second spring is located in said housing and urges said catch member to project from said housing.

27. The improvement claimed in claim 21, wherein said catch member is ball-shaped.

28. The improvement claimed in claim 21, wherein said catch member is pin-shaped.

29. The improvement claimed in claim 21, wherein said locking lever is mounted within said housing.

30. The improvement claimed in claim 21, wherein said axis extends vertically and said first spring urges said locking lever horizontally outwardly relative to said housing.

31. The improvement claimed in claim 21, wherein said second spring urges said catch member horizontally outwardly relative to said housing.

32. The improvement claimed in claim 21, wherein said first direction is parallel to a longitudinal dimension of said support rail.

33. The improvement claimed in claim 32, wherein said first direction is horizontal, and said second direction is vertically upward.

34. The improvement claimed in claim 21, wherein said locking lever comprises a double-armed lever including a first lever arm having an outer end to abut the detent edge and a second lever arm abutting said housing to limit the extent of pivoting of said lever arm about said axis.

35. A bracket to be mounted on a side of a furniture body and to be assembled to a support rail of a pull-out guide fitting for use in guiding sliding movement of a drawer into and out of the furniture body, said bracket comprising:

a detent edge to be abutted by a locking lever of the fitting to thereby prevent movement in a first direction of the support rail relative to said bracket; and a catch to be abutted by a catch member of the fitting to thereby prevent movement of the support rail relative to said bracket in a second direction transverse to said first direction.

36. A bracket as claimed in claim 35, wherein said bracket has at a rear end thereof a hook that engages with a rear end of the support rail when the drawer and the fitting are assembled to the furniture body.

37. A bracket as claimed in claim 35, wherein said detent edge is defined by a recess formed in said bracket.

38. A bracket as claimed in claim 35, wherein said detent edge is an edge of a tab bent from said bracket.

39. A bracket as claimed in claim 38, wherein said catch is formed on said tab.

40. A bracket as claimed in claim 35, wherein said catch comprises a groove formed in said bracket.

41. A bracket as claimed in claim 40, wherein said groove is elongated parallel to said first direction.

* * * * *